US011136236B2

(12) United States Patent
Edwards

(10) Patent No.: US 11,136,236 B2
(45) Date of Patent: Oct. 5, 2021

(54) HORSE BIT SYSTEM

(71) Applicant: Jo Edwards, Canadian, TX (US)

(72) Inventor: Jo Edwards, Canadian, TX (US)

( * ) Notice: Subject to any disclaimer, the term of this patent is extended or adjusted under 35 U.S.C. 154(b) by 0 days.

(21) Appl. No.: 17/101,733

(22) Filed: Nov. 23, 2020

(65) Prior Publication Data

US 2021/0155470 A1 May 27, 2021

Related U.S. Application Data

(60) Provisional application No. 62/939,441, filed on Nov. 22, 2019.

(51) Int. Cl.
*B68B 1/06* (2006.01)

(52) U.S. Cl.
CPC ..... *B68B 1/06* (2013.01)

(58) Field of Classification Search
CPC ..... B68B 1/04; B68B 1/06
USPC ..... 54/7–9
See application file for complete search history.

(56) References Cited

U.S. PATENT DOCUMENTS 120,860 A * 11/1871 Cornell ..... B68B 1/06 54/9
132,149 A * 10/1872 Eddy ..... B68B 1/06 54/7
141,334 A * 7/1873 Tergolina ..... B68B 1/06 54/7
422,469 A * 3/1890 Arsdale ..... B68B 1/06 54/7
422,529 A * 3/1890 Johnson et al. ..... B68B 1/06 54/9
422,900 A * 3/1890 Allen ..... B68B 1/06 54/7
501,987 A * 7/1893 Bartruff ..... B68B 1/06 54/9
529,472 A * 11/1894 Bigelow ..... B68B 1/06 54/7
574,304 A * 12/1896 Cramer ..... B68B 1/06 54/7
690,017 A * 12/1901 Craighead ..... B68B 1/06 54/7

(Continued)

FOREIGN PATENT DOCUMENTS

EP 3656732 A1 * 5/2020 ..... B68B 1/06

OTHER PUBLICATIONS

Jim Edwards Bits, Jun. 27, 2017, <http://jimedwardsbits.com> (Year: 2017).*

(Continued)

*Primary Examiner* — Peter M Poon
*Assistant Examiner* — Morgan T Barlow
(74) *Attorney, Agent, or Firm* — Shannon Warren

(57) ABSTRACT

A utility bit for training, riding, and restraining a horse improving the health of and physical contact with the horse's mouth. The utility bit includes two side shanks, and a mouthpiece. Each of the two side shanks includes a purchase bar, a bottom shank and a leverage bar. The purchase bar includes the bottom shank attached at a first end and the leverage bar at a second end. The bottom shank includes a bottom ring. The leverage bar includes a leverage ring. The first side shank and the second side shank rotate about a first shank axis and a second shank axis.

12 Claims, 9 Drawing Sheets

(56) References Cited

U.S. PATENT DOCUMENTS

| | | | | | |
|---|---|---|---|---|---|
| 864,641 | A | * | 8/1907 | Guedez | B68B 1/06 54/7 |
| 873,604 | A | * | 12/1907 | Reichert | B68B 1/06 54/9 |
| 1,107,223 | A | * | 8/1914 | Mullins | B68B 1/06 54/7 |
| 1,114,887 | A | * | 10/1914 | Koepke | B68B 1/04 54/6.1 |
| 2,469,046 | A | * | 5/1949 | Laws | B68B 1/06 54/6.1 |
| 3,628,308 | A | * | 12/1971 | Lozier | B68B 1/06 54/8 |
| 4,884,390 | A | * | 12/1989 | Benjak | B68B 1/06 54/7 |
| 4,941,312 | A | * | 7/1990 | Old, Sr. | B68B 1/06 54/8 |
| D328,657 | S | * | 8/1992 | Steele | D30/136 |
| D506,579 | S | * | 6/2005 | Balding | D30/136 |
| D579,115 | S | | 10/2008 | Edwards | |
| 2004/0200195 | A1 | * | 10/2004 | Collins, III | B68B 1/06 54/8 |
| 2008/0302069 | A1 | * | 12/2008 | Stevenson | B68B 1/06 54/8 |
| 2018/0305198 | A1 | * | 10/2018 | Cross | B68B 1/06 |
| 2019/0202683 | A1 | * | 7/2019 | Merrill | B68B 1/04 |

OTHER PUBLICATIONS

Jim Edwards Bits, Non-Palate Pressure Slider, Aug. 23, 2018 <http://jimedwardsbits.com/Shop/?t=Non-Palate%20Pressure&s=Slider> (Year: 2018).*

* cited by examiner

PRIOR ART

HORSE BIT SYSTEM

CROSS-REFERENCE TO RELATED APPLICATIONS

This application claims benefit to U.S. Patent Application No. 62/939,441 filed on 2019 Nov. 22.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

Applicant is the holder of U.S. Design Pat. D579,155, issued in 2008. The specification and claims are specifically distinguished form that application as discussed below. Other examples of horse bits include U.S. Pat. No. 4,884,390, and USD506579S1.

BRIEF SUMMARY OF THE INVENTION

A utility bit for training, riding, and restraining a horse. Said utility bit comprises two side shanks, and a mouthpiece. Said two side shanks comprise a first side shank and a second side shank. each of said two side shanks comprise a purchase bar, a bottom shank and a leverage bar. Said purchase bar comprise said bottom shank attached at A first end and said leverage bar at a second end. Said bottom shank comprises a bottom ring. Said leverage bar comprises a leverage ring. Said first side shank and said second side shank rotate about a first shank axis and a second shank axis. Said mouthpiece comprises a central portion of said utility bit between said two side shanks. Said mouthpiece comprises a port, an offset, lower port bars, and two purchase channel bars. Said lower port bars comprise a first lower port bar, and a second lower port bar. Said two purchase channel bars comprise a first purchase channel bar, and a second purchase channel bar. Said first purchase channel bar and said second purchase channel bar respectively align about said first shank axis and said second shank axis. Said purchase bar of said two side shanks respectively align and rotate about said first shank axis and said second shank axis. a portion of each purchase bar of said two side shanks is held within said first purchase channel bar and said second purchase channel bar so as to allow said purchase bar to rotate within the respective purchase channel bar. sloping down from said offset, said lower port bars connect to said two purchase channel bars on each side of said port. Said port is raised a height above said two purchase channel bars to allow room for a tongue of the horse and to fit comfortably in the top of a horse's mouth. Said mouthpiece further comprises support bars. Said support bars comprise a first support bar, and a second support bar. Said support bars connect from a portion of said port to said two purchase channel bars on both sides of said port and are configured to further support said port. Said lower port bars in said utility bit connect all the way into said two purchase channel bars. Said utility bit is configured to break the horse's poll by pressing said port against an upper mouth palate of the horse by pulling on said bottom ring, said leverage ring and a top ring.

Said utility bit for training, riding, and restraining a horse. Said utility bit comprises said two side shanks, and said mouthpiece. Said two side shanks comprise said first side shank and said second side shank. each of said two side shanks comprise said purchase bar, said bottom shank and said leverage bar. Said purchase bar comprise said bottom shank attached at said first end and said leverage bar at said second end. Said bottom shank comprises said bottom ring. Said leverage bar comprises said leverage ring. Said first side shank and said second side shank rotate about said first shank axis and said second shank axis. Said mouthpiece comprises a central portion of said utility bit between said two side shanks. Said mouthpiece comprises said port, said offset, said lower port bars, and said two purchase channel bars. Said lower port bars comprise said first lower port bar, and said second lower port bar. Said two purchase channel bars comprise said first purchase channel bar, and said second purchase channel bar. Said first purchase channel bar and said second purchase channel bar respectively align about said first shank axis and said second shank axis. Said purchase bar of said two side shanks respectively align and rotate about said first shank axis and said second shank axis. a portion of each purchase bar of said two side shanks is held within said first purchase channel bar and said second purchase channel bar so as to allow said purchase bar to rotate within the respective purchase channel bar. sloping down from said offset, said lower port bars connect to said two purchase channel bars on each side of said port. Said port is raised said height above said two purchase channel bars to allow room for said tongue of the horse and to fit comfortably in the top of a horse's mouth.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
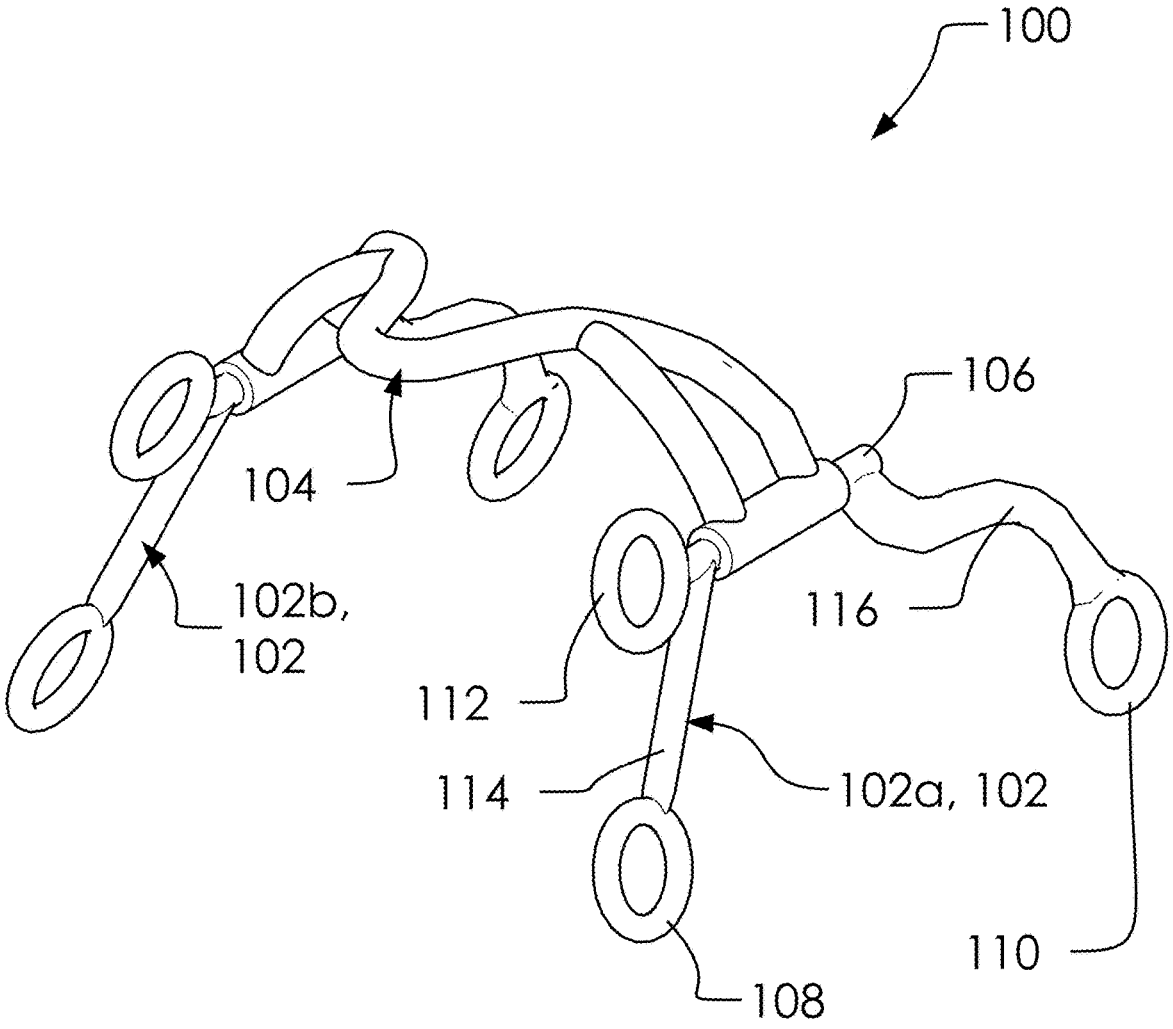
FIG. 1 illustrates a perspective overview of a utility bit 100.

FIG. 1 illustrates a perspective overview of a utility bit 100.

In one embodiment, said utility bit 100 can comprise an improved bit for training and manipulating a horse, as is known in the art.

Said utility bit 100 can comprise two side shanks 102 (which can comprise a first side shank 102*a*, and a second side shank 102*b*) and a mouthpiece 104. In one embodiment, said two side shanks 102 can each comprise a purchase bar 106, a bottom ring 108, a leverage ring 110, a top ring 112, a bottom shank 114, and a leverage bar 116.

Figure 2:
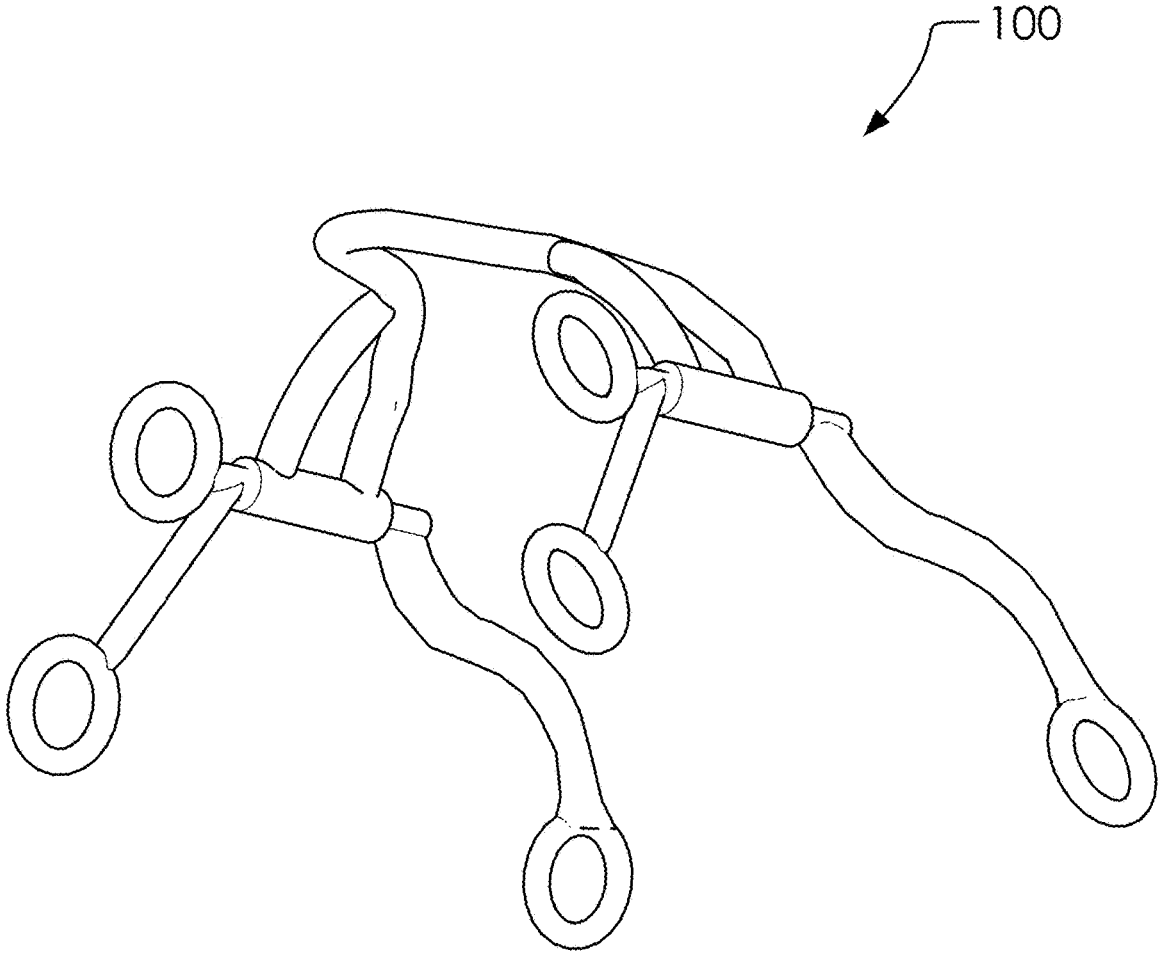
FIG. 2 illustrates a perspective lower view of said utility bit 100.

FIG. 2 illustrates a perspective lower view of said utility bit 100.

Figure 3A:
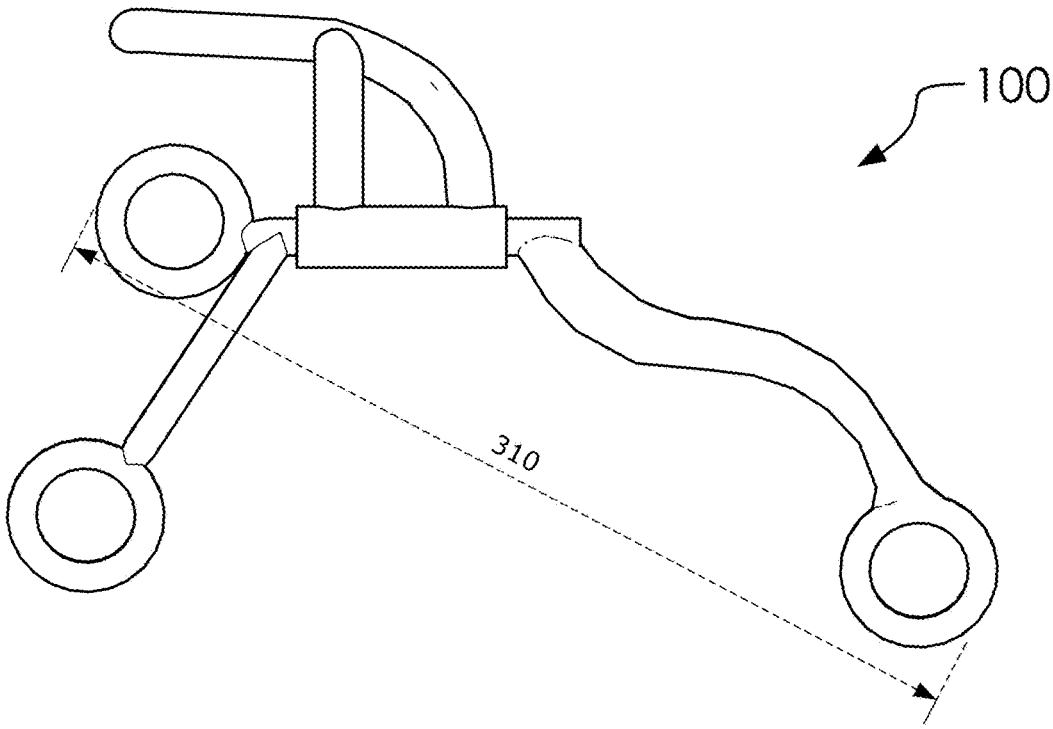
FIGS. 3A and 3B illustrate an elevated side view and top view of said utility bit 100.
Figure 3B:
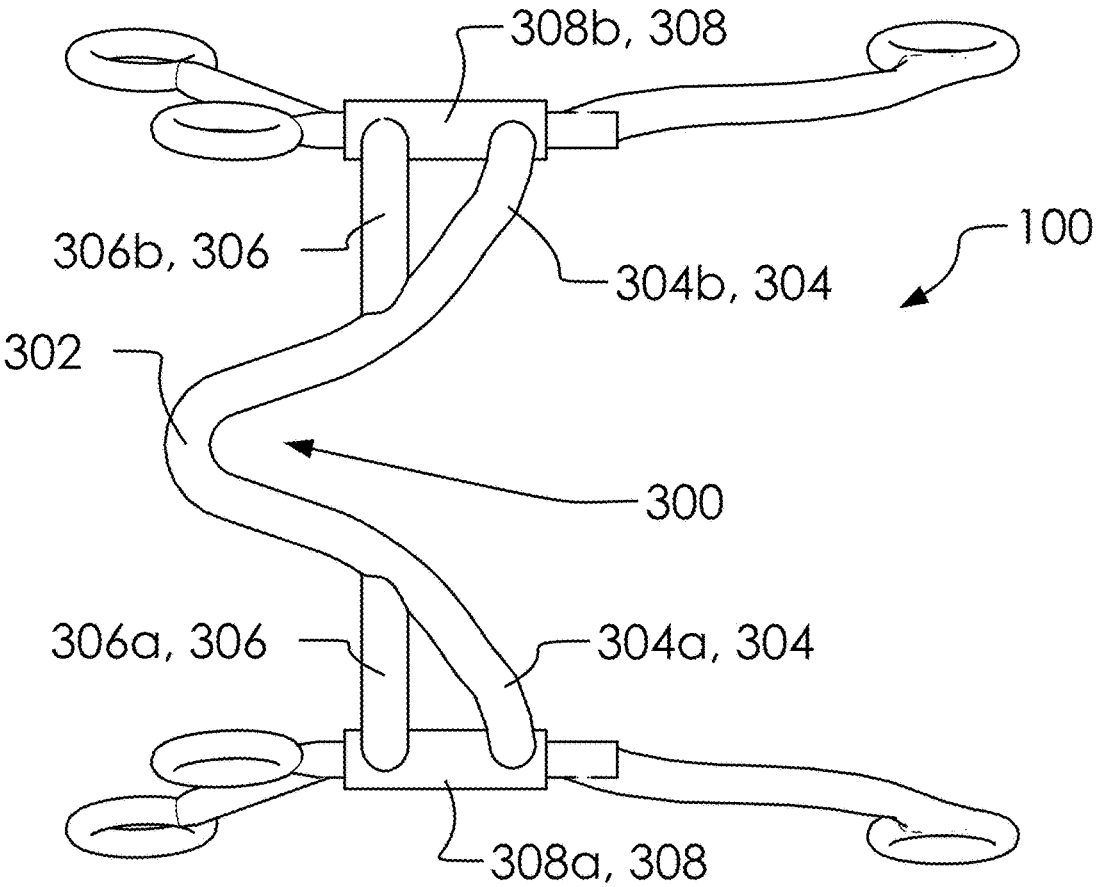

FIGS. 3A and 3B illustrate an elevated side view and top view of said utility bit 100.

In one embodiment, said mouthpiece 104 can comprise a central portion of said utility bit 100 between said two side shanks 102. Further, said mouthpiece 104 can comprise a port 300, an offset 302, lower port bars 304 (which can comprise a first lower port bar 304*a*, and a second lower port bar 304*b*), support bars 306 (which can comprise a first support bar 306*a*, and a second support bar 306*b*), and two purchase channel bars 308 (which can comprise a first purchase channel bar 308*a*, and a second purchase channel bar 308*b*). In one embodiment, each of said two side shanks 102 can comprise a total shank length 310 comprising said top ring 112 connected to said purchase bar 106, connected to said leverage bar 116 and finally connected to said leverage ring 110.

Said offset 302 can relieve the horse's tongue when it is rotated and pressed against the animal's jaw.

Figure 4:
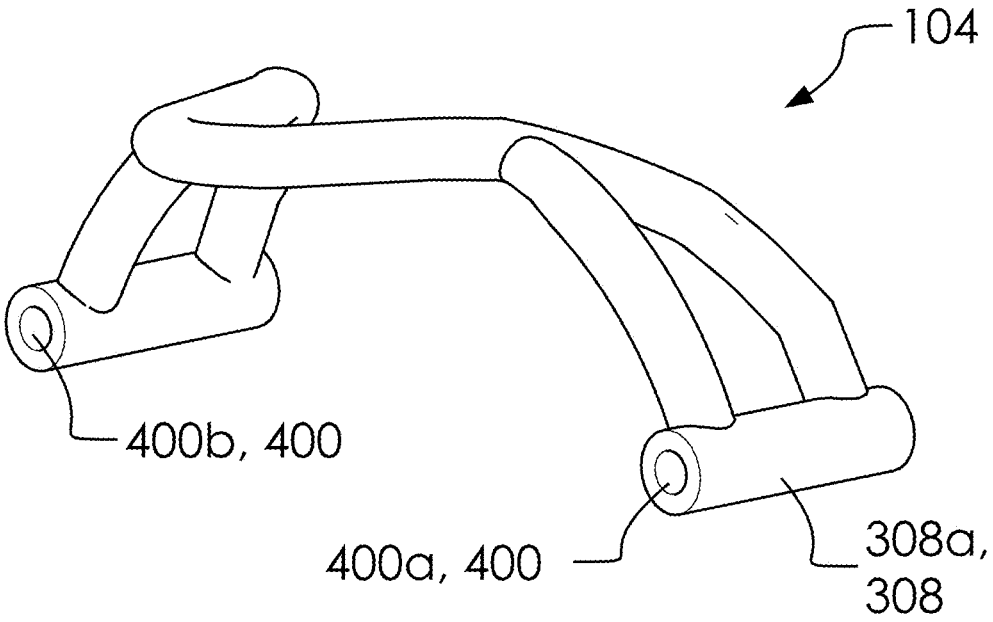
FIG. 4 illustrates a perspective overview of a mouthpiece 104.

FIG. 4 illustrates a perspective overview of said mouthpiece 104.

In one embodiment, each of said lower port bars 304 can comprise a purchase bar channel 400 (which can comprise a first purchase bar channel 400*a* in said first lower port bar 304*a*, and a second purchase bar channel 400*b* in said second lower port bar 304*b*).

Figure 5A:
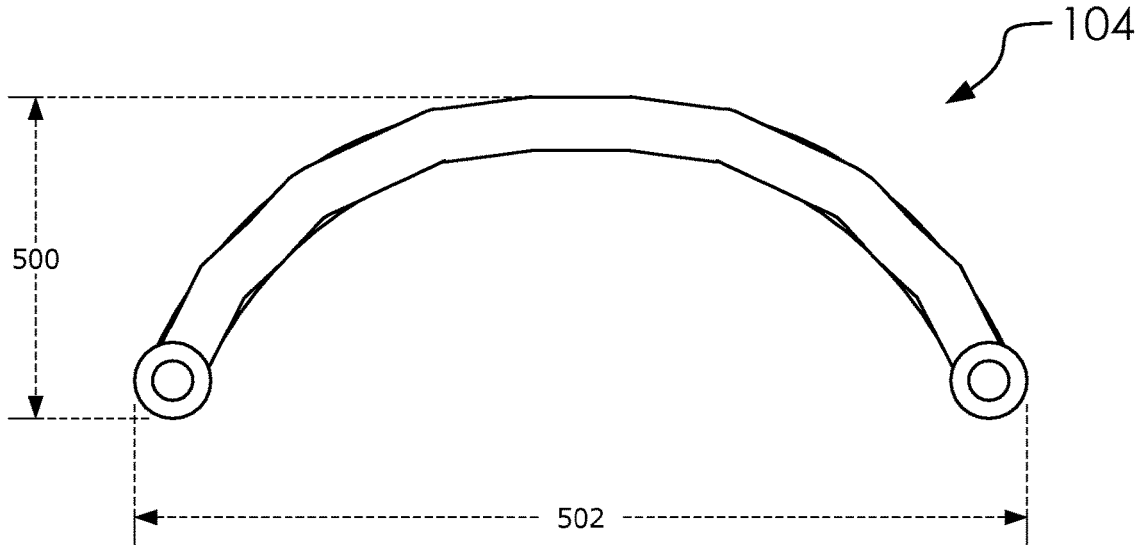
FIGS. 5A and 5B illustrate an elevated front and top view of said mouthpiece 104.
Figure 5B:
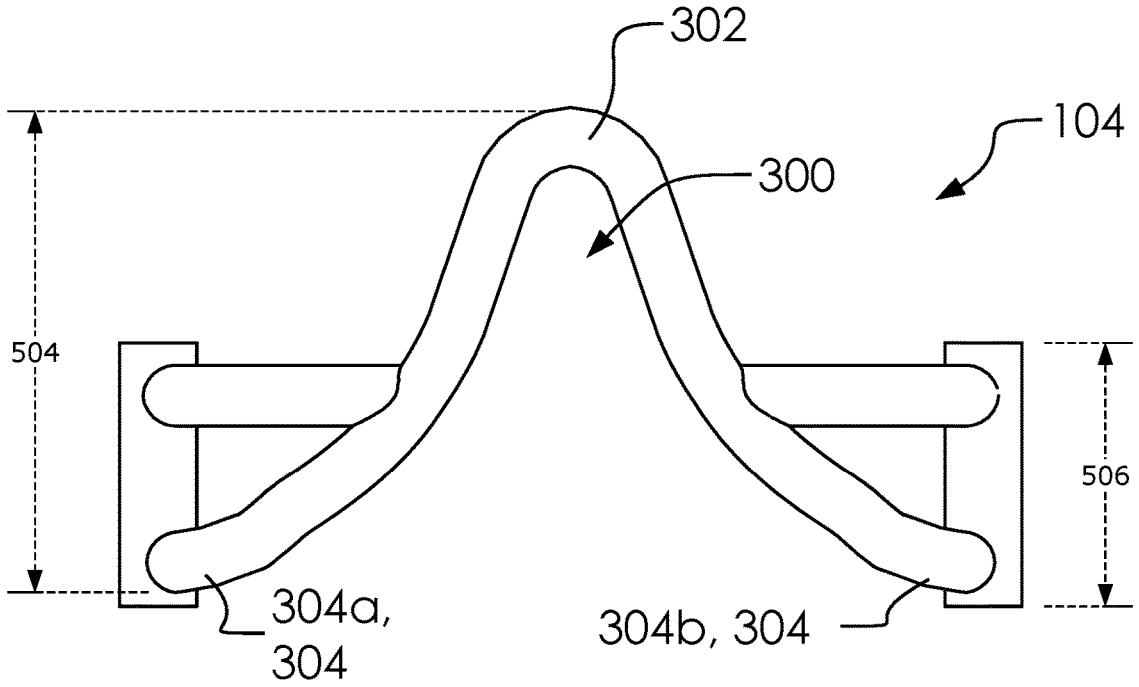

FIGS. 5A and 5B illustrate an elevated front and top view of said mouthpiece 104.

As discussed herein, dimensions of said utility bit 100 are exemplary and do not represent a strict requirement for functionality. Certain parts can vary according to industry standards.

In one embodiment, said mouthpiece 104 can comprise a height 500 of 4.445 centimeters (1.75 inches), a width 502 of 14.605 centimeters (5.75 inches). Said port 300 from said offset 302 to said lower port bars 304 can comprise a length 504 being equal to 8.89 centimeters (3.5 inches). In one embodiment, said first purchase channel bar and said second purchase channel bar can comprise a channel bar length 506. Said purchase channel gap length 506 can comprise a distance between said bottom shank and said leverage bar. Said channel bar length can be substantially equal to said purchase channel gap length 506; wherein, said two side shanks are substantially prevented from sliding forward and back within said two purchase channel bars due to said bottom shank and said leverage bar on either side of said two purchase channel bars.

Figure 6A:
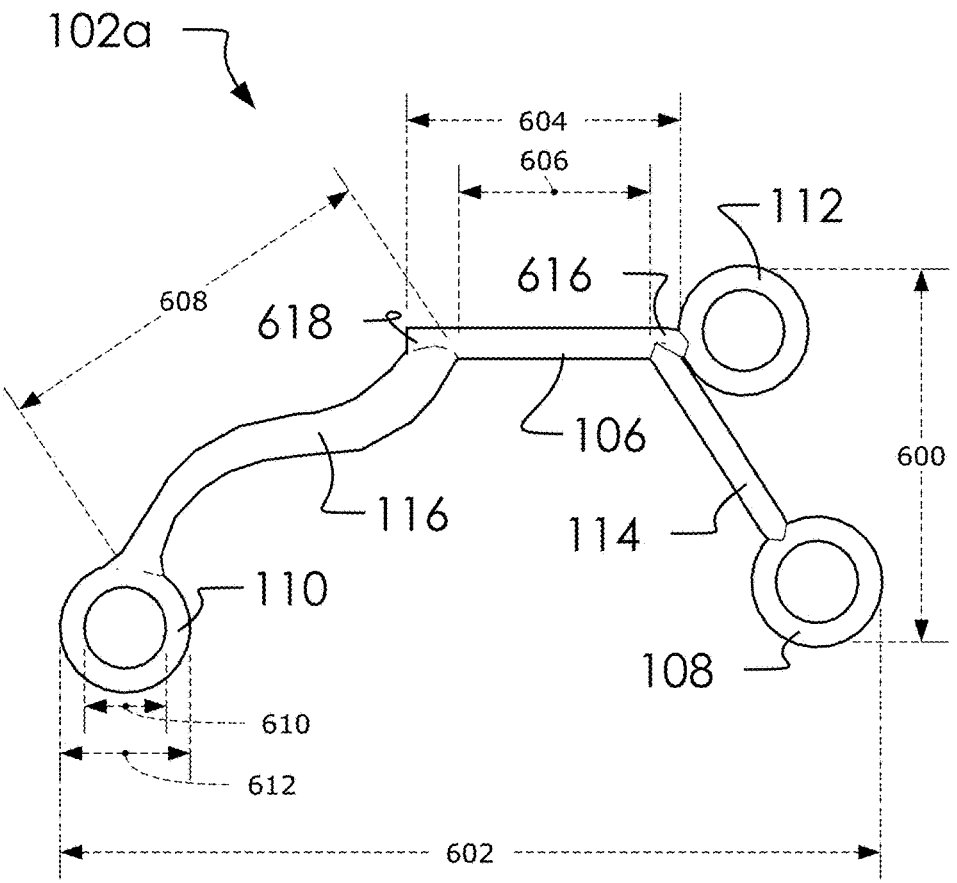
FIGS. 6A, 6B and 6C illustrate an elevated side, front, and bottom view of a first side shank 102*a*.
Figure 6B:
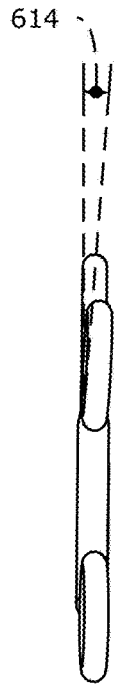
Figure 6C:
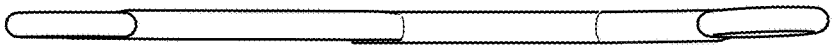

FIGS. 6A, 6B and 6C illustrate an elevated side, front, and bottom view of said first side shank 102*a*.

In one embodiment, said two side shanks 102 can comprise a shank assembly height 600 of 8.89 centimeters (3.5 inches), and a shank assembly length 602 of 21.59 centimeters (8.5 inches). Said purchase bar 106 can comprise a purchase bar length 604, and a purchase channel gap length 606. Said leverage bar 116 can comprise a leverage bar length 608. Each of said bottom ring 108, said leverage ring 110 and said top ring 112 can comprise an internal diameter 610 and an external diameter 612, which can be 3.175 centimeters (1.25 inches) and 4.445 centimeters (1.75 inches), respectively. Said bottom ring 108 and said top ring 112 can be tilted slightly at an offset angle 614 which can be away from said mouthpiece 104.

Figure 7A:
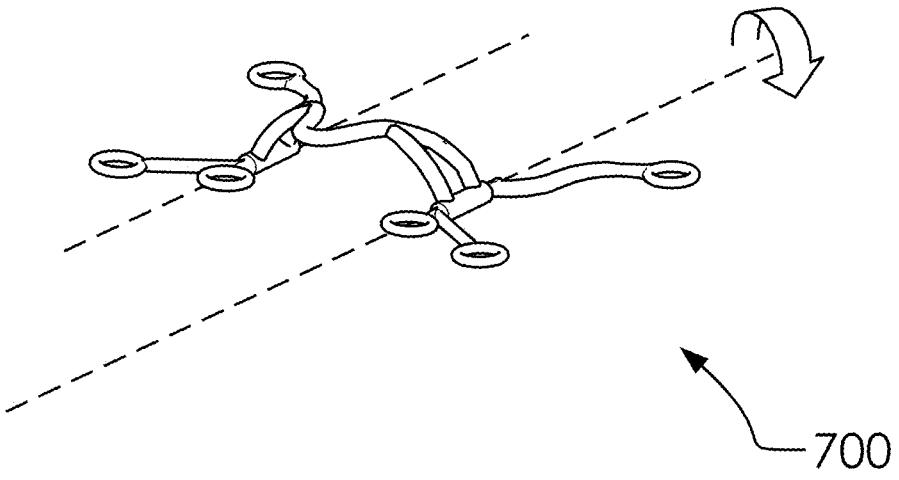
FIGS. 7A and 7B illustrate a perspective overview of said utility bit 100 with two side shanks 102 in a flat configuration 700 and a lowered configuration 702, respectively.
Figure 7B:
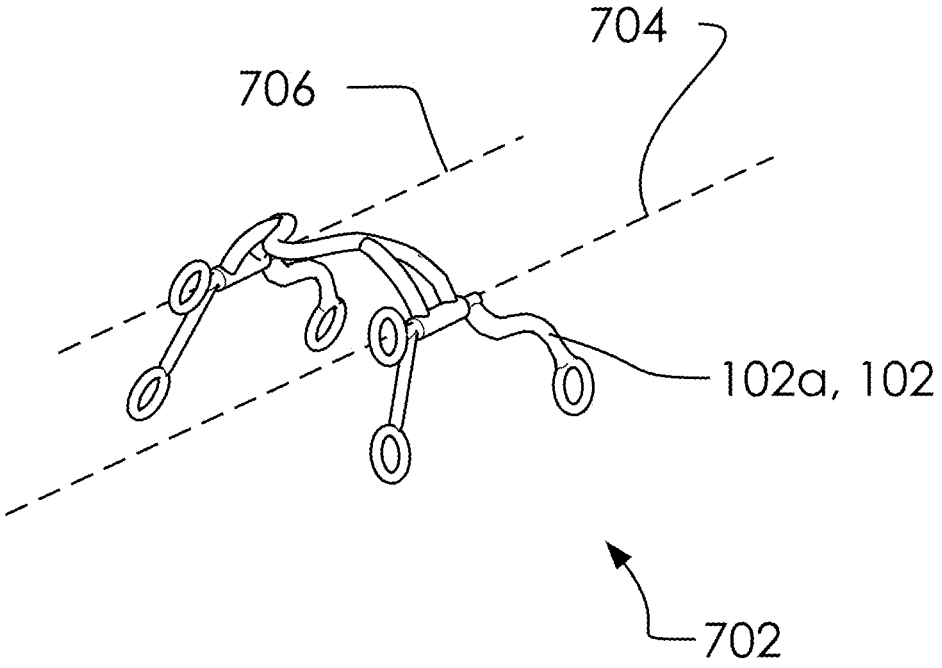

FIGS. 7A and 7B illustrate a perspective overview of said utility bit 100 with said two side shanks 102 in a flat configuration 700 and a lowered configuration 702, respectively.

In one embodiment, said first side shank 102*a* and said second side shank 102*b* can rotate about a first shank axis 704 and a second shank axis 706.

Figure 8A:
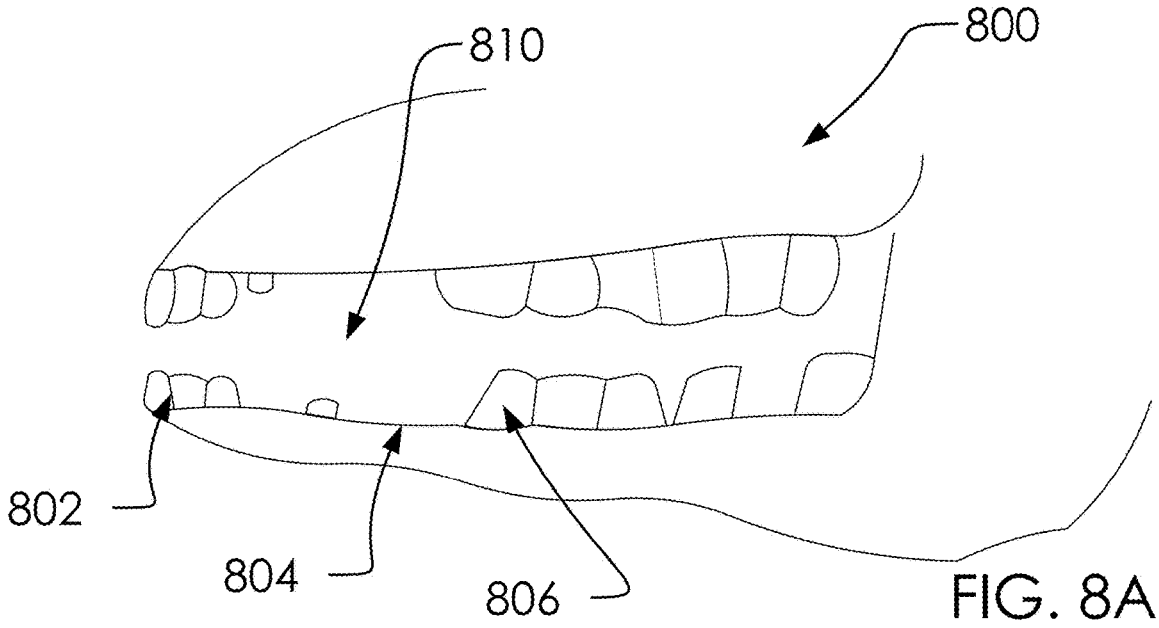
FIGS. 8A and 8B illustrate an elevated side view of an horse skull 800 with and without said utility bit 100.
Figure 8B:
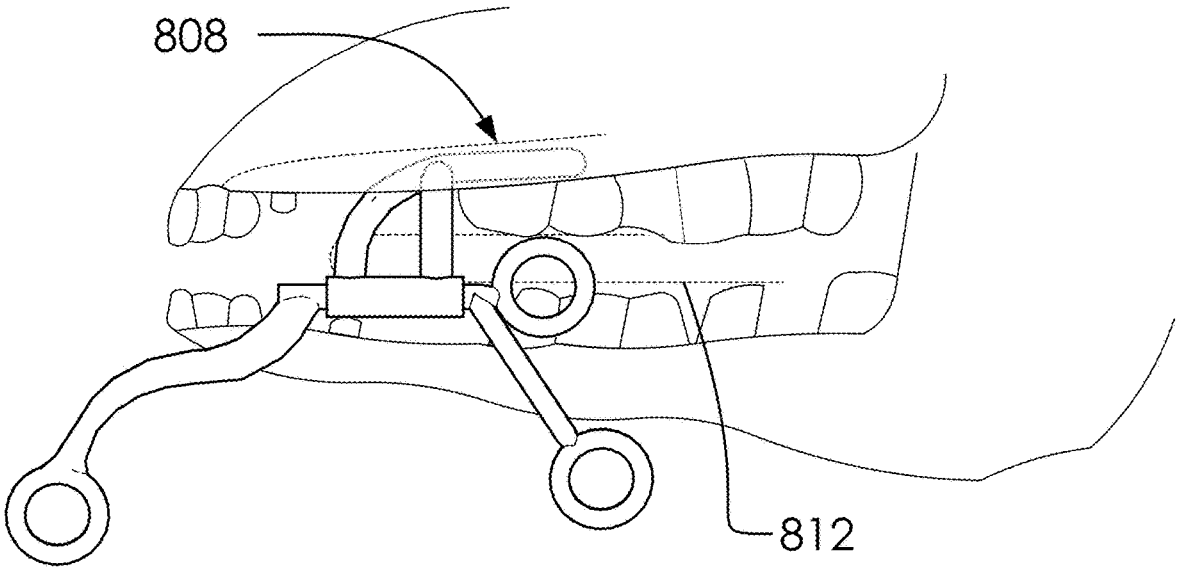

FIGS. 8A and 8B illustrate an elevated side view of an horse skull 800 with and without said utility bit 100.

Said horse skull 800 comprises a forward dental area 802, an interdental area 804, and a rear dental area 806.

One advantage of said utility bit 100 can comprise improving a mouth health of a mouth 810 of the horse when training and riding an animal. For example, because said port 300 and said offset 302 are placed in an upper mouth palate 808 and because said lower port bars 304, said support bars 306 and said two purchase channel bars 308 clear into said mouth 810 without irritating said forward dental area 802 and said rear dental area 806, the friction effects of said utility bit 100 are keenly felt in in said interdental area 804.

Figure 9A:
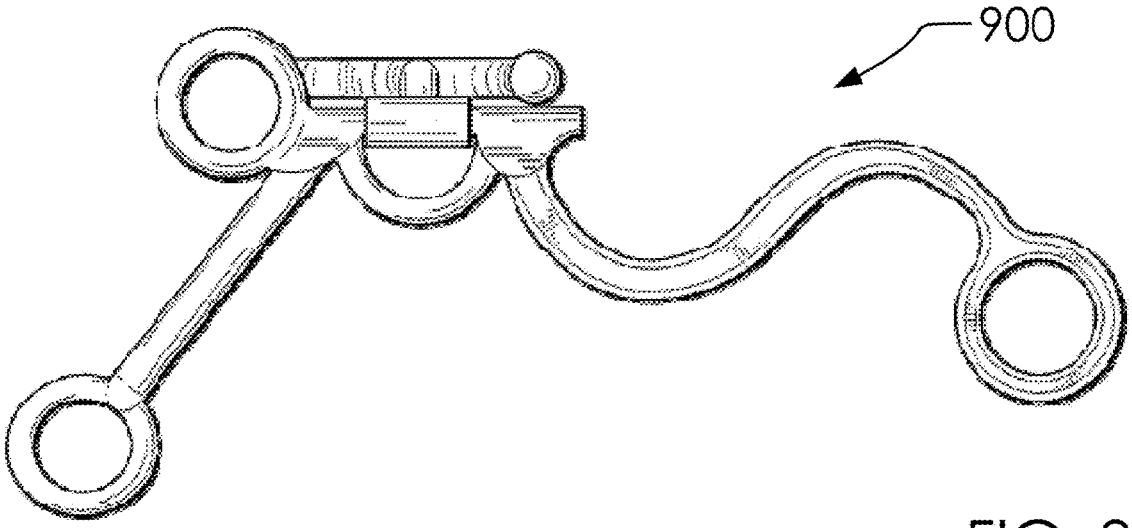
FIG. 9A PRIOR ART
FIGS. 9A and 9B illustrate a prior art utility bit 900.
Figure 9B:
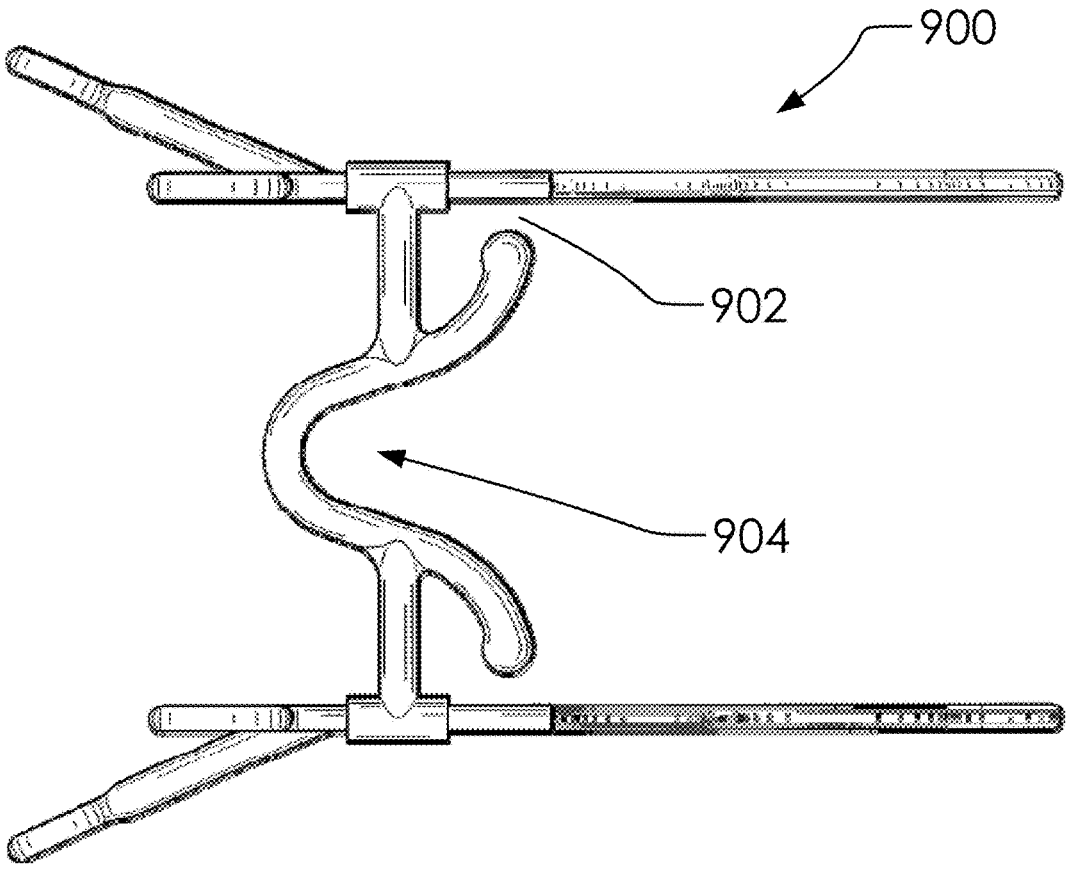

FIGS. 9A and 9B illustrate a prior art utility bit 900.

Many of the prior art utility bits rub, shift and hit the animal's face during use.

Likewise, D579,155 filed by the current inventor, shown in FIGS. 9A and 9B as said prior art utility bit 900, has many differences from the current system. For example, said lower port bars 304 in said utility bit 100 connect all the way into said two purchase channel bars 308. Similarly, a port 904 of said prior art utility bit 900 is flat and does not rise above said two purchase channel bars 308; whereas, said port 300 of said utility bit 100 can be raised above said two purchase channel bars 308 to allow room for a tongue 812.

As a design goal, said utility bit 100 sets out to fit comfortably in the top of the mouth and to bow up on two sides for maximum contact with the fleshy tissue instead of the bars. Likewise, by rotating said two side shanks 102, the user is given additional leverage as said offset 302 pushes up as said leverage ring 110 is pressed down.

One goal in training a horse is to break a poll of the horse to tuck his head down with his chin back. Trainers commonly refer to the C1 vertebra as the temporal bone or the "poll". Once the poll is broken, the horse is better balanced. In many cases, a horse will naturally have his balance pushed forward; wherein, by breaking the poll, his weight will shift backward toward balanced.

A trainer can collect the horse and his energy for further training, by breaking the poll.

One advantage of said utility bit 100 is to break the poll even in an untrained horse.

In one embodiment, the scale of said utility bit 100 can be changed to accommodate different sized animals. For example, said height 500, said width 502, said length 504, said shank assembly height 600, said shank assembly length 602 and said leverage bar length 608 can be altered according to a training objective or animal size.

Said utility bit 100 for training, riding and restraining a horse. Said utility bit 100 can comprise said two side shanks 102, and said mouthpiece 104. Said two side shanks 102 comprise said first side shank 102*a* and said second side shank 102*b*. Said mouthpiece 104 comprise each of said two side shanks 102 comprise said purchase bar 106, said bottom shank 114 and said leverage bar 116. Said purchase bar 106 comprise said bottom shank 114 attached at A first end 616 and said leverage bar 116 at a second end 618. Said bottom shank 114 can comprise said bottom ring 108. Said leverage bar 116 can comprise said leverage ring 110. Said first side shank 102*a* and said second side shank 102*b* rotate about said first shank axis 704 and said second shank axis 706. Said first shank axis 704 and said second shank axis 706 can be formed by rotatably holding a portion of said purchase bar 106 within said purchase bar channel 400 of said mouthpiece 104. Said mouthpiece 104 can comprise a central portion of said utility bit 100 between said two side shanks 102. Said mouthpiece 104 can comprise said port 300, said offset 302, said lower port bars 304, said support bars 306, and said two purchase channel bars 308. Said lower port bars 304 comprise said first lower port bar 304*a*, and said second lower port bar 304*b*., said support bars 306 comprise said first support bar 306*a*, and said second support bar 306*b*). and said two purchase channel bars 308 comprise said first purchase channel bar 308*a*, and said second purchase channel bar 308*b*. Said port 300 can be raised said height 500 above said two purchase channel bars 308 to allow room for said tongue 812 of the horse. Said utility bit 100 fits comfortably in the top of the mouth and bows up on two sides for maximum contact with the fleshy tissue instead of the bars.

Said mouthpiece 104 can comprise said height 500 of 4.445 centimeters (1.75 inches), and said width 502 of 14.605 centimeters (5.75 inches).

Said port 300 from said offset 302 to said lower port bars 304 can comprise said length 504 being equal to 8.89 centimeters (3.5 inches).

Said two side shanks 102 can comprise said shank assembly height 600 of 8.89 centimeters (3.5 inches), and said shank assembly length 602 of 21.59 centimeters (8.5 inches).

Each of said bottom ring 108, said leverage ring 110 and said top ring 112 can comprise said internal diameter 610 and said external diameter 612, which can be 3.175 centimeters (1.25 inches) and 4.445 centimeters (1.75 inches), respectively.

Said purchase bar 106 can comprise said purchase bar length 604, and said purchase channel gap length 606. Said leverage bar 116 can comprise said leverage bar length 608.

Said bottom ring 108 and said top ring 112 can be tilted slightly at said offset angle 614 which can be away from said mouthpiece 104.

Said lower port bars 304 in said utility bit 100 connect all the way into said two purchase channel bars 308.

Said utility bit 100 can be configured to break a poll of the horse and therefore to tuck the horse's head back with his chin down. by breaking the poll, a trainer can collect the horse and his energy for further training. Said utility bit 100 can be configured to break the horse's poll by pressing said port 300 against said upper mouth palate 808 of the horse by pulling on said bottom ring 108, said leverage ring 110 and said top ring 112.

The following listing of parts are included for the convenience of the reader:

said utility bit 100,
said two side shanks 102,
said first side shank 102*a*,
said second side shank 102*b*,
said mouthpiece 104,
said purchase bar 106,
said bottom ring 108,
said leverage ring 110,
said top ring 112,
said bottom shank 114,
said leverage bar 116,
said port 300,
said offset 302,
said lower port bars 304,
said first lower port bar 304*a*,
said second lower port bar 304*b*,
said support bars 306,
said first support bar 306*a*,
said second support bar 306*b*,
said two purchase channel bars 308,
said first purchase channel bar 308*a*,
said second purchase channel bar 308*b*,
said total shank length 310,
said purchase bar channel 400,
said first purchase bar channel 400*a*,
said second purchase bar channel 400*b*,
said height 500,
said width 502,
said length 504,
said shank assembly height 600,
said shank assembly length 602,
said purchase bar length 604,
said purchase channel gap length 606,
said leverage bar length 608,
said internal diameter 610,
said external diameter 612,
said offset angle 614,
said first end 616,
said second end 618,
said flat configuration 700,
said lowered configuration 702,
said first shank axis 704,
said second shank axis 706,
said horse skull 800,
said forward dental area 802,
said interdental area 804,
said rear dental area 806,
said upper mouth palate 808,
said mouth 810,
said tongue 812,
said prior art utility bit 900, and
said port 904.

The following paragraphs are modeled after the original claims and serve to ensure all subject matter covered in the claim is equally covered in the specification.

Said utility bit 100 for training, riding, and restraining a horse. Said utility bit 100 comprises said two side shanks 102, and said mouthpiece 104. Said two side shanks 102 comprise said first side shank 102*a* and said second side shank 102*b*. each of said two side shanks 102 comprise said purchase bar 106, said bottom shank 114 and said leverage bar 116. Said purchase bar 106 comprise said bottom shank 114 attached at said first end 616 and said leverage bar 116 at said second end 618. Said bottom shank 114 comprises said bottom ring 108. Said leverage bar 116 comprises said leverage ring 110. Said first side shank 102*a* and said second side shank 102*b* rotate about said first shank axis 704 and said second shank axis 706. Said mouthpiece 104 comprises a central portion of said utility bit 100 between said two side shanks 102. Said mouthpiece 104 comprises said port 300, said offset 302, said lower port bars 304, and said two purchase channel bars 308. Said lower port bars 304 comprise said first lower port bar 304*a*, and said second lower port bar 304*b*. Said two purchase channel bars 308 comprise said first purchase channel bar 308*a*, and said second purchase channel bar 308*b*. Said first purchase channel bar 308*a* and said second purchase channel bar 308*b* respectively align and rotate about said first shank axis 704 and said second shank axis 706. Said purchase bar 106 of said two side shanks 102 respectively align and rotate about said first shank axis 704 and said second shank axis 706. a portion of each purchase bar 106 of said two side shanks 102 can be held within said first purchase channel bar 308*a* and said second purchase channel bar 308*b* so as to allow said purchase bar 106 to rotate within the respective purchase channel bar 308. sloping down from said offset 302, said lower port bars 304 connect to said two purchase channel bars 308 on each side of said port 300. Said port 300 can be raised said height 500 above said two purchase channel bars 308 to allow room for said tongue 812 of the horse and to fit comfortably in the top of a horse's mouth. Said mouthpiece 104 further comprises said support bars 306. Said support bars 306 comprise said first support bar 306*a*, and said second support bar 306*b*. Said support bars 306 connect from a portion of said port 300 to said two purchase channel bars 308 on both sides of said port 300 and can be configured to further support said port 300. Said lower port bars 304 in said utility bit 100 connect all the way into said two purchase channel bars 308. Said utility bit 100 can be configured to break the horse's poll by pressing said port 300 against said upper mouth palate 808 of the horse by pulling on said bottom ring 108, said leverage ring 110 and said top ring 112.

Said utility bit 100 for training, riding, and restraining a horse. Said utility bit 100 comprises said two side shanks 102, and said mouthpiece 104. Said two side shanks 102 comprise said first side shank 102*a* and said second side shank 102*b*. each of said two side shanks 102 comprise said purchase bar 106, said bottom shank 114 and said leverage bar 116. Said purchase bar 106 comprise said bottom shank 114 attached at said first end 616 and said leverage bar 116 at said second end 618. Said bottom shank 114 comprises said bottom ring 108. Said leverage bar 116 comprises said leverage ring 110. Said first side shank 102*a* and said second side shank 102*b* rotate about said first shank axis 704 and said second shank axis 706. Said mouthpiece 104 comprises a central portion of said utility bit 100 between said two side shanks 102. Said mouthpiece 104 comprises said port 300, said offset 302, said lower port bars 304, and said two purchase channel bars 308. Said lower port bars 304 comprise said first lower port bar 304*a*, and said second lower port bar 304*b*. Said two purchase channel bars 308 comprise said first purchase channel bar 308*a*, and said second purchase channel bar 308*b*. Said first purchase channel bar 308*a* and said second purchase channel bar 308*b* respectively align and rotate about said first shank axis 704 and said second shank axis 706. Said purchase bar 106 of said two side shanks 102 respectively align and rotate about said first shank axis 704 and said second shank axis 706. a portion of each purchase bar 106 of said two side shanks 102 can be held within said first purchase channel bar 308*a* and said second purchase channel bar 308*b* so as to allow said purchase bar 106 to rotate within the respective purchase channel bar 308. sloping down from said offset 302, said lower port bars 304 connect to said two purchase channel bars 308 on each side of said port 300. Said port 300 can be raised said height 500 above said two purchase channel bars 308 to allow room for said tongue 812 of the horse and to fit comfortably in the top of a horse's mouth.

Said utility bit 100 further comprise said top ring 112. Said top ring 112 can be attached to a front portion of each among said purchase bar 106.

Said mouthpiece 104 further comprises said support bars 306. Said support bars 306 comprise said first support bar 306*a*, and said second support bar 306*b*. Said support bars 306 connect from a portion of said port 300 to said two purchase channel bars 308 on both sides of said port 300 and can be configured to further support said port 300.

Said mouthpiece 104 comprises said height 500 of 4.445 centimeters (1.75 inches), and said width 502 of 14.605 centimeters (5.75 inches).

Said port 300 from said offset 302 to said lower port bars 304 comprises said length 504 being equal to 8.89 centimeters (3.5 inches).

Said two side shanks 102 comprises said shank assembly height 600 of 8.89 centimeters (3.5 inches), and said shank assembly length 602 of 21.59 centimeters (8.5 inches).

each of said bottom ring 108, and said leverage ring 110 comprises said internal diameter 610 and said external diameter 612, which can be 3.175 centimeters (1.25 inches) and 4.445 centimeters (1.75 inches), respectively.

Said purchase bar 106 comprises said purchase bar length 604, and said purchase channel gap length 606. Said leverage bar 116 comprises said leverage bar length 608.

Said bottom ring 108 and said top ring 112 can be tilted slightly at said offset angle 614 which can be away from said mouthpiece 104.

Said lower port bars 304 in said utility bit 100 connect all the way into said two purchase channel bars 308.

Said utility bit 100 can be configured to break the horse's poll by pressing said port 300 against said upper mouth palate 808 of the horse by pulling on said bottom ring 108, said leverage ring 110 and said top ring 112.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A utility bit for training, riding, and restraining a horse, wherein:

said utility bit comprises two side shanks, and a mouthpiece;

said two side shanks comprise a first side shank and a second side shank;

each of said two side shanks comprise a purchase bar, a bottom shank and a leverage bar;

each of said purchase bar comprises said bottom shank attached at a first end and said leverage bar at a second end;

said bottom shank comprises a bottom ring;

said leverage bar comprises a leverage ring;

said first side shank and said second side shank rotate about a first shank axis and a second shank axis;

said mouthpiece comprises a central portion of said utility bit between said two side shanks;

said mouthpiece comprises a port, an offset, lower port bars, and two purchase channel bars;

said lower port bars comprise a first lower port bar, and a second lower port bar;

said two purchase channel bars comprise a first purchase channel bar, and a second purchase channel bar;

said first purchase channel bar and said second purchase channel bar respectively align about said first shank axis and said second shank axis;

said purchase bar of said two side shanks respectively align and rotate about said first shank axis and said second shank axis;

a portion of each purchase bar of said two side shanks is held within said first purchase channel bar and said second purchase channel bar so as to allow said purchase bar to rotate within the respective purchase channel bar;

sloping down from said offset, said lower port bars connect to said two purchase channel bars on each side of said port;

said port is raised a height above said two purchase channel bars to allow room for a tongue of the horse and to fit comfortably in the top of a horse's mouth;

said mouthpiece further comprises support bars;

said support bars comprise a first support bar and a second support bar;

said support bars connect from a portion of said port to said two purchase channel bars on both sides of said port and are configured to further support said port;

said support bars connect at one end to a portion of said port, slope down and connect at a second end to a portion of said purchase channel bars;

said lower port bars in said utility bit connect all the way to said two purchase channel bars;

said utility bit is configured to break the horse's poll by pressing said port against an upper mouth palate of the horse by pulling on said bottom ring, said leverage ring and a top ring;

said first purchase channel bar and said second purchase channel bar comprise a channel bar length;

each said purchase bar comprises a purchase bar length and a purchase channel gap length;

said purchase channel gap length comprises a distance between said bottom shank and said leverage bar;

said channel bar length is substantially equal to said purchase channel gap length;

wherein, said two side shanks are substantially prevented from sliding forward and back within said two purchase channel bars due to said bottom shank and said leverage bar on either side of said two purchase channel bars.

2. A utility bit for training, riding, and restraining a horse, wherein:

said utility bit comprises two side shanks, and a mouthpiece;

said two side shanks comprise a first side shank and a second side shank;

each of said two side shanks comprise a purchase bar, a bottom shank and a leverage bar;

said purchase bar comprise said bottom shank attached at a first end and said leverage bar at a second end;

said bottom shank comprises a bottom ring;

said leverage bar comprises a leverage ring;

said first side shank and said second side shank rotate about a first shank axis and a second shank axis;

said mouthpiece comprises a central portion of said utility bit between said two side shanks;

said mouthpiece further comprises a port, an offset, lower port bars, and two purchase channel bars;

said lower port bars comprise a first lower port bar, and a second lower port bar;

said two purchase channel bars comprise a first purchase channel bar, and a second purchase channel bar;

said first purchase channel bar and said second purchase channel bar align about said first shank axis and said second shank axis, respectively;

said purchase bar of said two side shanks align and rotate about said first shank axis and said second shank axis, respectively;

a portion of each purchase bar of said two side shanks is held within said first purchase channel bar and said second purchase channel bar so as to allow said purchase bar to rotate within the respective purchase channel bar;

sloping down from said offset, said lower port bars connect to said two purchase channel bars on each side of said port; and said port is raised to a height above said two purchase channel bars to allow room for a tongue of the horse and to fit comfortably in the top of a horse's mouth;

said first purchase channel bar and said second purchase channel bar comprise a channel bar length;

each said purchase bar comprises a purchase bar length and a purchase channel gap length;

said purchase channel gap length comprises a distance between said bottom shank and said leverage bar;

said channel bar length is substantially equal to said purchase channel gap length;

wherein, said two side shanks are substantially prevented from sliding forward and back within said two purchase channel bars due to said bottom shank and said leverage bar on either side of said two purchase channel bars.

3. The utility bit of claim 2, wherein:

said utility bit further comprise a top ring; and said top ring are attached to a front portion of each said purchase bar.

4. The utility bit of claim 2, wherein:

said mouthpiece further comprises support bars;

said support bars comprise a first support bar, and a second support bar;

said support bars connect from a portion of said port to said two purchase channel bars on both sides of said port and are configured to further support said port; and said support bars connect at one end to a portion of said port, slope down and connect at a second end to a portion of said purchase channel bars.

5. The utility bit of claim 2, wherein:

said mouthpiece comprises said height of 4.445 centimeters (1.75 inches), and a width of 14.605 centimeters (5.75 inches).

6. The utility bit of claim 2, wherein:

said port from said offset to said lower port bars comprises a length being equal to 8.89 centimeters (3.5 inches).

7. The utility bit of claim 2, wherein:

said two side shanks comprises a shank assembly height of 8.89 centimeters (3.5 inches), and a shank assembly length of 21.59 centimeters (8.5 inches).

8. The utility bit of claim 2, wherein:

each of said bottom ring, and said leverage ring comprises an internal diameter and an external diameter, are 3.175 centimeters (1.25 inches) and 4.445 centimeters (1.75 inches), respectively.

9. The utility bit of claim 2, wherein:

said purchase bar comprises a purchase bar length, and a purchase channel gap length; and said leverage bar comprises a leverage bar length.

10. The utility bit of claim 2, wherein:

said bottom ring and a top ring are tilted slightly at an offset angle are away from said mouthpiece.

11. The utility bit of claim 2, wherein:

said lower port bars in said utility bit connect all the way to said two purchase channel bars.

12. The utility bit of claim 2, wherein:

said utility bit is configured to break the horse's poll by pressing said port against an upper mouth palate of the horse by pulling on said bottom ring, said leverage ring and a top ring.

* * * * *